US005853956A

United States Patent [19]

Taguchi

[11] Patent Number: 5,853,956

[45] Date of Patent: Dec. 29, 1998

[54] PROCESSING METHOD OF SILVER HALIDE LIGHT SENSITIVE PHOTOGRAPHIC MATERIAL

[75] Inventor: Masaaki Taguchi, Hino, Japan

[73] Assignee: Konica Corporation, Tokyo, Japan

[21] Appl. No.: 914,742

[22] Filed: Aug. 19, 1997

[30] Foreign Application Priority Data

Aug. 23, 1996 [JP] Japan ..... 8-222293

[51] Int. Cl.[6] ..... G03C 5/29

[52] U.S. Cl. ..... 430/491; 430/963

[58] Field of Search ..... 430/491, 567, 430/963

[56] References Cited

U.S. PATENT DOCUMENTS

| | | | |
|---|---|---|---|
| 5,391,466 | 2/1995 | Ueda et al. | 430/393 |
| 5,498,511 | 3/1996 | Yamashita et al. | 430/496 |
| 5,705,325 | 1/1998 | Hosoi | 430/502 |

FOREIGN PATENT DOCUMENTS 0 553 569 A1 8/1993 European Pat. Off. .

*Primary Examiner*—Hoa Van Le

*Attorney, Agent, or Firm*—Frishauf, Holtz, Goodman, Langer & Chick, P.C.

[57] ABSTRACT

A processing method of a silver halide photographic material comprising a support having on at least one side of the support hydrophilic colloid layers including a silver halide emulsion layer is disclosed, in which the silver halide emulsion layer contains tabular silver halide grains having an average chloride content of 20 mol % or more and an aspect ratio of 2 or more; and a coating weight ratio of silver to gelatin of said hydrophilic colloid layers is 0.6 or more; the photographic material being developed in the presence of a compound represented by the following formula (I) or (II):

formula (I)

formula (II)

6 Claims, No Drawings

PROCESSING METHOD OF SILVER HALIDE LIGHT SENSITIVE PHOTOGRAPHIC MATERIAL

FIELD OF THE INVENTION

The present invention is related to a method for processing a silver halide light sensitive photographic material and specifically to a processing method of a silver halide light sensitive photographic material, which is superior in biodegradability and resistance to roller marking and suitable for rapid processing at a low replenishing rate.

BACKGROUND OF THE INVENTION

Recently, processing of a silver halide light sensitive photographic material (hereinafter, simply referred to as light sensitive photographic material or photographic material) has advanced in shortening of the processing time and, lowering of the replenishing rates of processing solutions.

Rapid processing is conventionally performed by an automatic processor at high temperature and to complete processing within a short period of time, there is desired a photographic material which is still more superior in developability and fixability, and dryable within a shorter time after washing. There have been proposed a variety of means for enhancing the developability and fixability, including a decrease in size of silver halide grains, an increase of the silver chloride content, the decrease of a silver iodide content, reduction of the binder coating amount and lowering of the degree of hardening. There have also been proposed means for enhancing dryability, such as reduction of the binder coating amount and lowering of the degree of hardening. Incidentally to achieve developability and fixability, reduction of binder coating amount is an important concern.

Further, reduction of the replenishing rate of a replenishing solution and development of a processing solution the effluent of which contains no environmentally undesirable ingredient are desired in terms of environment protection. Processing solutions contain a variety of ingredients and if water used for preparing the processing solution contains metal ions such as calcium, magnesium or iron, precipitates or sludge are produced on reaction of the metal ion with some of the ingredients, disadvantageously causing clogging of a filter provided in the processor or adhering to a photographic material to produce stains. Even when pure water is used, metal ions are leached out of the processed photographic material or are carried-in from the prior step, so that it is difficult to completely prevent occurrence of precipitates and sludge. In addition, there are disadvantages that ingredients contained in the processing solution are acceleratedly oxidized or decomposed by the action of metal ions and lose their efficacy, resulting in an increase of fog density or reduction of sensitivity. This tendency becomes increasingly marked when processing is carried out at a low replenishing rate. In order to prevent these shortcomings, there is known the addition of a metal ion-sequestering agent, or a so-called chelating agent to prevent formation of precipitates. Examples of such a chelating agent conventionally employed include ethylenediaminetetraacetic acid (EDTA), diethylenetriaminepentaacetic acid (DTPA) and nitrilotriacetic acid(NTA). However, these conventionally employed chelating agents are low in biodegradability and cause other problems such that when processing effluent containing the chelating agent is treated by an activated sludge process, the chelating agent is not easily degraded.

Accordingly, a chelating agent with superior biodegradability is desired. JP-A 5-281684 (herein, the term, "JP-A" means unexamined and published Japanese Patent Application) and JP-A 6-161065 disclose chelating agents with improved biodegradability. However, these chelating agents were proved to have the problem such that resistance to roller marking was lowered in a photographic material in which the binder content was decreased for the purpose of enhancing rapid processability and processability at a lowered replenishing rate. On the other hand, an increase of the binder content or a raise of the degree of hardening improves the resistance to roller marking but deteriorates developability and fixability, which is detrimental for rapid processing or low-replenishment processing.

SUMMARY OF THE INVENTION

An object of the present invention is to provide a method for processing a silver halide light sensitive photographic material, which is superior in biodegradability and resistance to roller marking and suited for rapid processing at a low replenishing rate.

The object of the invention can be accomplished by the following:

(1) A method for processing a silver halide light sensitive photographic material comprising a support having thereon hydrophilic colloid layers including a silver halide emulsion layer, characterized in that said silver halide emulsion layer contains tabular silver halide grains having a chloride content of 20 mol % or more, an aspect ratio of 2 or more and a ratio by weight of silver to gelatin contained in the hydrophilic colloid layers (Ag/Gel) is 0.6 or more; the photographic material being developed in the presence of a compound represented by the following Formula (I) or (II):

formula (I)

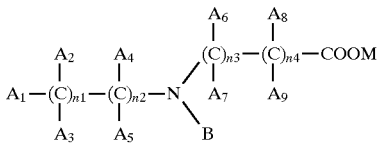

In the Formula, B represents a hydrogen atom, OH of $CH_2COOM$. When B is a hydrogen atom, $A_1$ through $A_9$ represent a hydrogen atom, OH, $C_nH_{2n+1}$ or $(CH_2)_mX$, in which n is an integer of 1 to 3, m is an integer of 0 to 3 and X represents COOM, $NH_2$ or OH. $n_1=1$, $n_2=1$, $n_3$ and $n_4$ are each an integer of zero or more and $n_3+n_4=1$ to 4 provided that all of $A_1$ to $A_5$ are not a hydrogen atoms at the same time. When B is OH or $CH_2COOM$, $n_i$ and $n_2$ are each an integer including 0 and $n_1+n_2=2$, $n_3=0$ and $n_4=1$, $A_1$, $A_8$ and $A_9$, represent a hydrogen atom, $A_2$ to $A_5$ each represent a hydrogen atom, OH, COOM, $PO_3(M)_2$, $CH_2COOM$, $CH_2OH$ or an a lower alkyl group, provided that at least one of $A_2$ to $A_5$ represents $CH_2COOM$, COOM or $PO_3(M)_2$, in which M represents a hydrogen atom, an alkali metal or ammonium group.

formula (II)

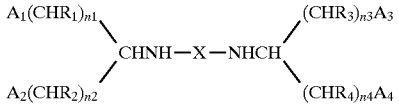

In the Formula, $A_1$ through $A_4$ each represent COOM or OH, $n_1$ through $n_4$ each represent an integer of 0 to 2. $R_1$ through $R_4$ each represent a hydrogen atom, OH or a lower alkyl group. X represents an alkylene group having 2 to 6 carbon atoms or $—(B_1O)_m—B_2—$, in which $B_1$ and $B_2$ each represent an alkylene group having 1 to 5 carbon atoms and m is an integer of 1 to 5. M represents a hydrogen atom, alkali metal or ammonium group.

(2) The processing method of a silver halide light sensitive photographic material described in (1), characterized in that the compound represented by Formula (I) or (II) is contained in a developer.

(3) The processing method of a silver halide light sensitive photographic material described in (1) or (2), characterized in that a developer replenishing rate is 260 ml or less per $m^2$ of the photographic material.

(4) The processing method of a silver halide light sensitive photographic material described in (1), (2) or (3), characterized in that among isomers of the compound represented by Formula (I) or (II), a [S,S] isomer is selectively employed.

DETAILED DESCRIPTION OF THE INVENTION

The compound represented by Formula (I) or (II) will be described.

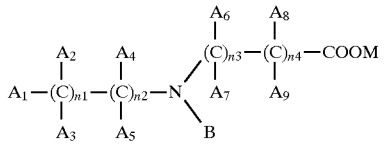

formula (I)

In Formula (I), B represents a hydrogen atom, OH of $CH_2COOM$. When B is a hydrogen atom, $A_1$ through $A_9$ represent a hydrogen atom, OH, $C_nH_{2n+1}$ or $(CH_2)_mX$, in which n is an integer of 1 to 3, m is an integer of 0 to 3 and X represents COOM, $NH_2$ or OH. $n_1=1$, $n_2=1$, $n_3$ and $n_4$ are each an integer and $n_3+n_4=1$ to 4 provided that all of $A_1$ to $A_5$ are not a hydrogen atoms at the same time. When B is OH or $CH_2COOM$, $n_1$ and $n_2$ are each an integer including 0 and $n_1n_2=2$, $n_3=0$ and $n_4=1$, $A_1$, $A_8$ and $A_9$ represent a hydrogen atom, $A_2$ to $A_5$ each represent a hydrogen atom, OH, COOM, $PO_3(M)_2$, $CH_2COOM$, $CH_2OH$ or a lower alkyl group (e.g., methyl, ethyl, iso-propyl, butyl, pentyl), provided that at least one of $A_2$ to $A_5$ represents $CH_2COOM$, COOM or $PO_3(M)_2$, in which M represents a hydrogen atom, an alkali metal (e.g., Na, K, Li) or ammonium group.

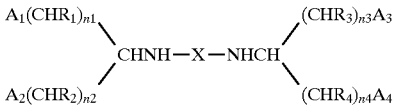

formula (II)

In the Formula, $A_1$ through $A_4$ each represent COOM or OH, $n_1$ through $n_4$ each represent an integer of 0 to 2. $R_1$ through $R_4$ each represent a hydrogen atom, OH or a lower alkyl group (e.g., a lower alkyl group with 1 to 6 carbon atoms, such as methyl, ethyl, iso-propyl, butyl, pentyl). X represents an alkylene group having 2 to 6 carbon atoms (e.g., ethylene group, propylene group, butylene group, hexylene group) or $—(B_1O)_m—B_2—$, in which $B_1$ and $B_2$ each represent an alkylene group having 1 to 5 carbon atoms (e.g., ethylene group, propylene group, butylene group, hexylene group) and m is an integer of 1 to 5. M represents a hydrogen atom, alkali metal (e.g., Na, K, Li) or ammonium group.

Exemplary examples of the compound represented by Formula (I) or (II) are shown below, but the invention is not limited to these examples.

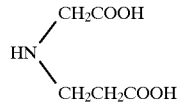

I-1

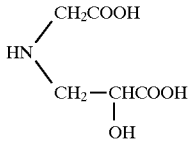

I-2

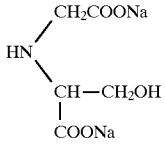

I-3

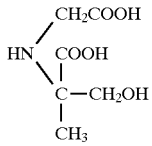

I-4

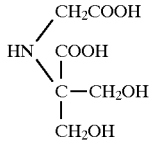

I-5

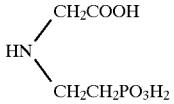

I-6

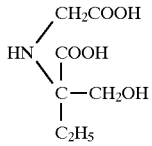

I-7

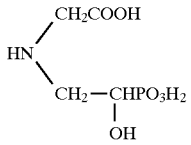

I-8

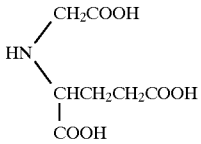

I-9

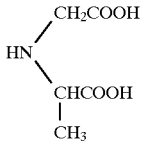

I-10

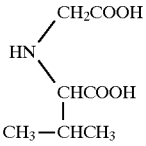

I-11

-continued
I-12
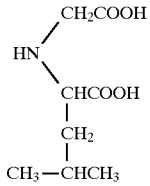
I-13
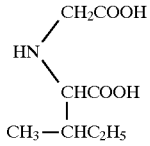
I-14
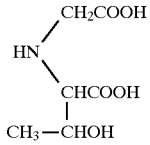
I-15
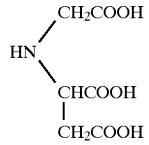
I-16
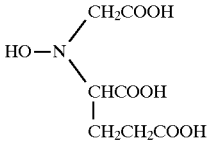
I-17
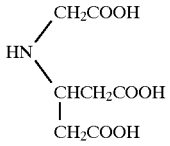
I-18
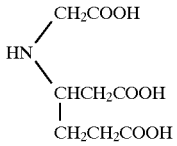
I-19
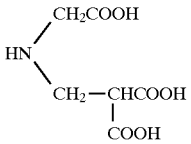
I-20
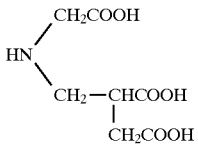
I-21
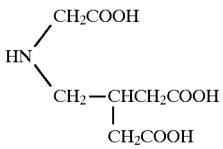
-continued
I-22
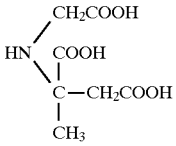
I-23
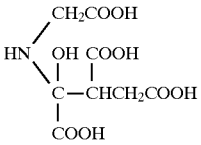
I-24
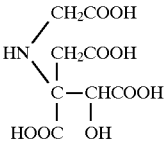
I-25
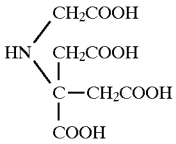
I-26
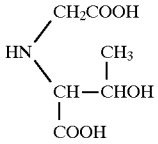
I-27
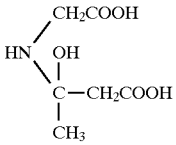
I-28
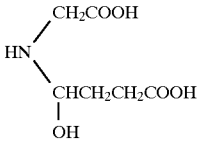
I-29
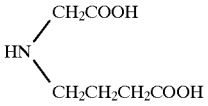
I-30
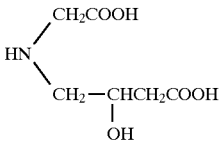
I-31
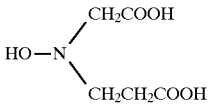
I-32
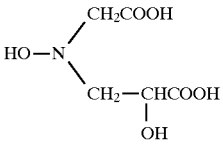

-continued
I-33
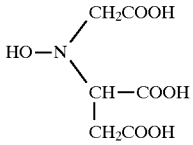
I-34
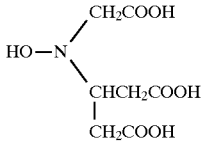
I-35
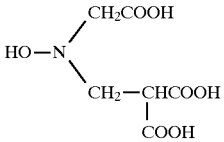
I-36
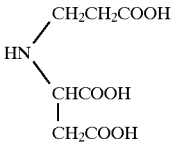
I-37
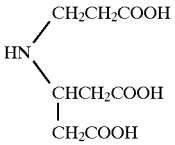
I-38
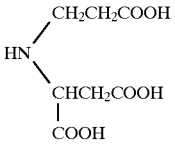
I-39
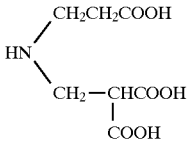
I-40
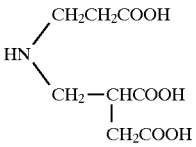
I-41
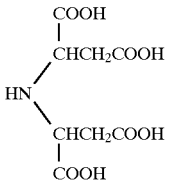
I-42
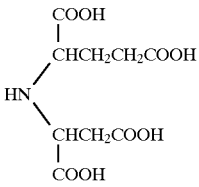
-continued
I-43
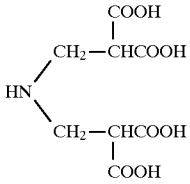
I-44
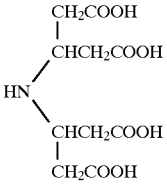
I-45
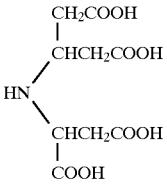
I-46
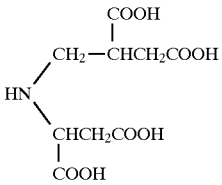
I-47
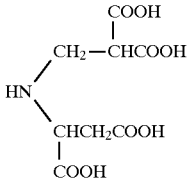
I-48
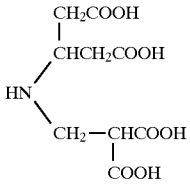
I-49
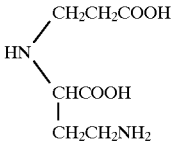
I-50
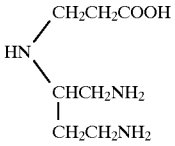
I-51
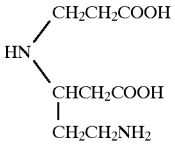

-continued
I-52
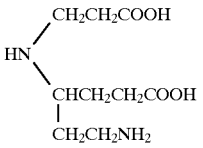
I-53
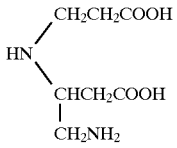
I-54
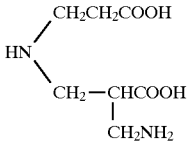
I-55
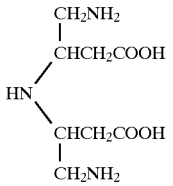
I-56
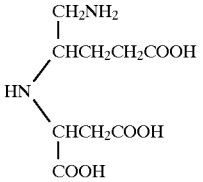
I-57
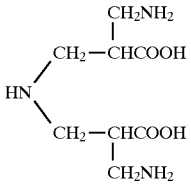
I-58
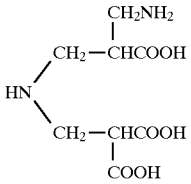
I-59
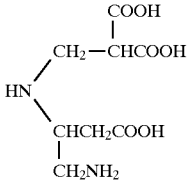
I-60
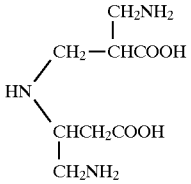
-continued
I-61
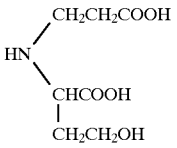
I-62
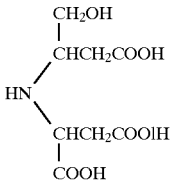
I-63
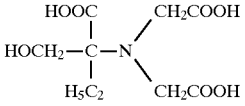
I-64
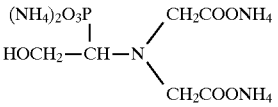
I-65
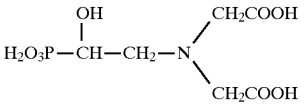
I-66
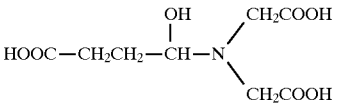
I-67
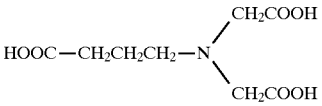
I-68
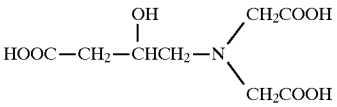
II-1
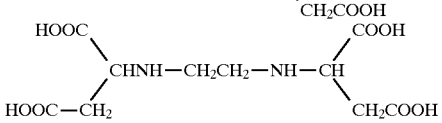
II-2
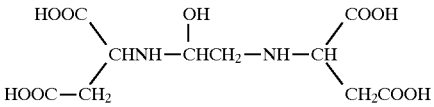
II-3
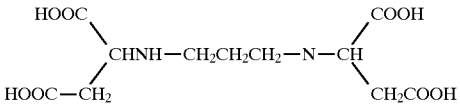
II-4
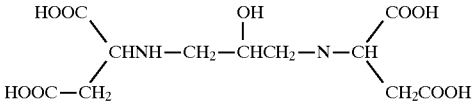
II-5
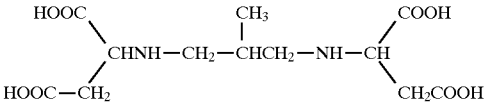

-continued
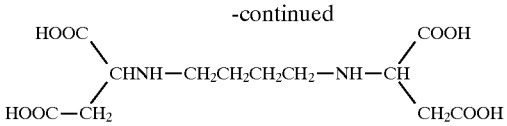
II-6
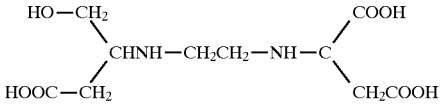
II-7
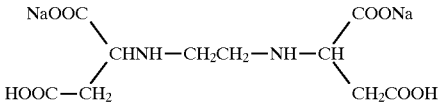
II-8
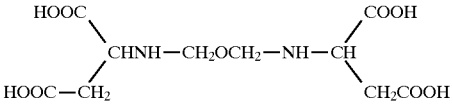
II-9
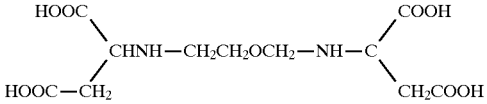
II-10
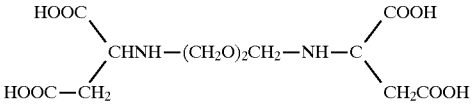
II-11
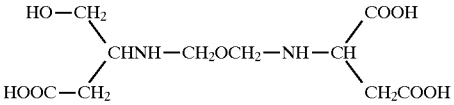
II-12
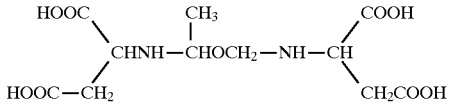
II-13
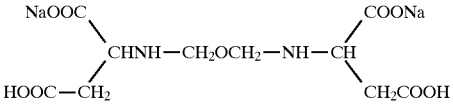
II-14
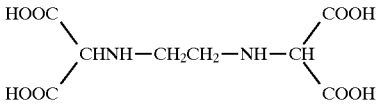
II-15
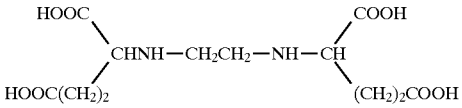
II-16
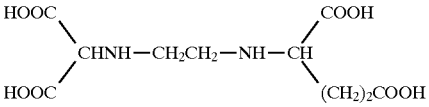
II-17
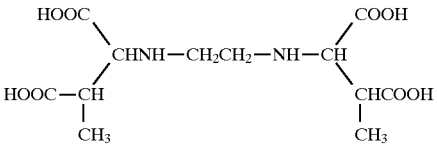
II-18
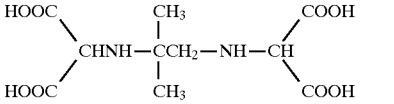
II-19
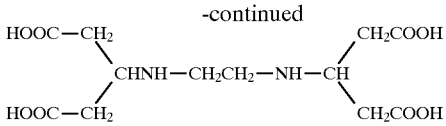
II-20
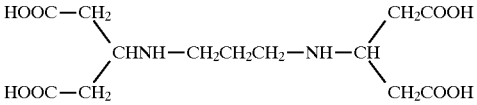
II-21
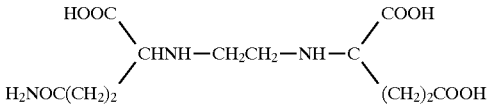
II-22
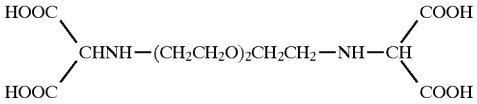
II-23
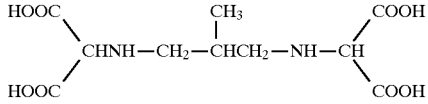
II-24
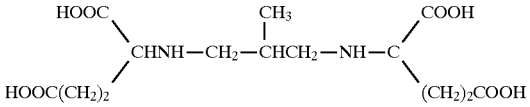
II-25
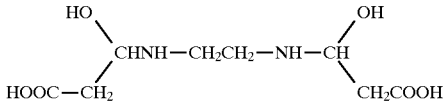
II-26
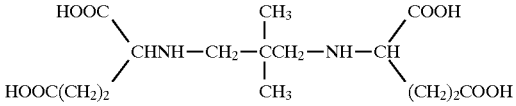
II-27
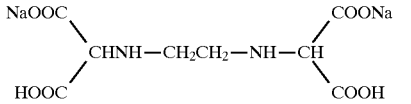
II-28
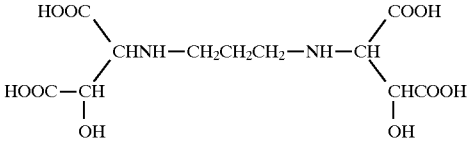
II-29
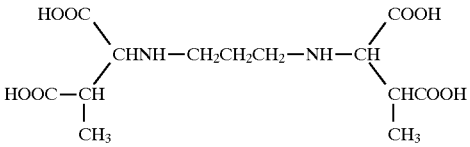
II-30
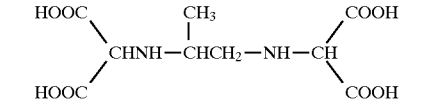
II-31
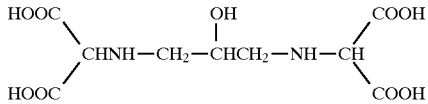
II-32
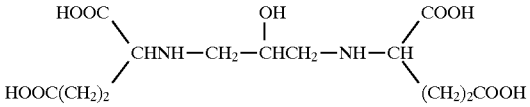
II-33

-continued

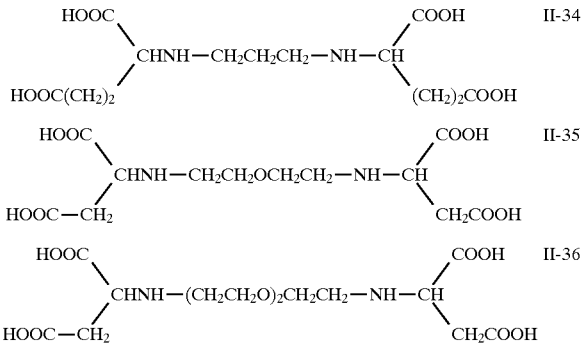

The compound represented by formula (2) or (3) includes its optical isomers, such as [S,S] isomer, [S,R] isomer, [R,S] isomer and [R,R] isomer. For example, exemplified compound (II-1) may be a [S,S] isomer, [S,R] isomer or [R,R] isomer, or a mixture of these optical isomers. Herein, the notation, "[S,S], [S,R], [R,S] and [R,R]" is based on the Cahn-Ingold-Prelog system, as well known in the art [Cahn, Ingold, and Prelog, Angew. Chem. Intern. Ed. Engl. 5, 385–415 (1966)]. Among these isomers, it is preferred that the [S,S] isomer is selectively employed. These optical isomers are preferably made from corresponding L-amino acids.

The [S,S] isomer is preferred in terms of being readily biodegradable. Herein, the expression, "selectively employed" means that the [S,S] isomer preferably accounts for not less than 70% and more preferably, not less than 90% of a mixture of these optical isomers.

The compounds represented by formulas (2) and (3) are commercially available or can be readily synthesized according to methods described in JP-A 63-199295 and 3-173857. Selective synthesis of the [S,S] isomer is referred to Umezawa et al., Journal of Antibiotics Vol. XXXVI No.4, pp.426 (April 1984).

The compound represented by Formula (I) or (II) is present in a developer. Thus the compound may be incorporated into a developer or a photographic material, and preferably incorporated into a developer. The compound represented by Formula (I) or (II) is preferably incorporated into a developer in an amount of 0.005 to 1.0 mol and more preferably 0.05 to 0.5 mol per liter of a developer.

The silver halide photographic material relating to the invention may or may or not (and preferably) contain the compound represented by Formula (I) or (II). The compound is incorporated into the photographic in the form of an aqueous solution of its alkali salts (e.g., sodium hydroxide, potassium hydroxide). The compound may also be incorporated through solution in an organic solvent (e.g., methanol, ethanol, ethyl acetate). Further, the compound may be dissolved in a high boiling solvent and dispersed in hydrophilic binder. The compound can be employed singly or in combination and incorporated into a photographic material in amount of 0.005 to 5 g and preferably 0.01 to 1 g per $m^2$ of the photographic material. A layer to be incorporated is not limited and according to the purpose, the compound is incorporated into not only an emulsion layer but also a protective layer, filter layer, interlayer, anti-halation layer, support or backing layer. The compound may be separately incorporated into any of these layers.

A silver halide emulsion relating to the invention contains tabular silver halide grains having a chloride content of 20 mol % or more and an aspect ration of 2 or more and preferably tabular silver halide grains having parallel twin planes.

In the invention, the tabular silver halide grains have an average value of a ratio of grain size to thickness (hereinafter, denoted as aspect ratio) of 2.0 or more, preferably, 2.0 to 12 and more preferably, 3 to 8. When the aspect ratio exceeds 12, pressure resistance (e.g., abrasion mark, kinking mark) is deteriorated and silver image tone is also deteriorated. An average grain size of the tabular silver halide grains used in the invention is preferably 0.3 to 3.0 $\mu$m and more preferably 0.5 to 1.5 $\mu$m. An average grain thickness of the tabular grains is preferably 0.5 $\mu$m or less and more preferably 0.3 $\mu$m or less.

Advantages of the tabular grains are associated with enhancement of spectral sensitization and improvements in graininess and sharpness, as described in British patent 2,112,157 and U.S. Pat. Nos. 4,439,520, 4,433,048, 4,414,310 and 4,434,226. The emulsion can be prepared according to methods described in these references.

The grain size of the tabular grains is referred to grain diameter, which is defined as a diameter of a circle equivalent to grain projected area determined from electronmicrographic observation of the grains. The grain thickness is defined as a minimum distance between two parallel planes constituting the tabular grain, i.e., distance between major faces. The thickness of tabular grains can be determined from shadowed electronmicrograph or electronmicrograph of sections of a photographic material sample coated with a silver halide emulsion on a support. The average aspect ratio can be determined from the measurement of at least 100 samples.

In a silver halide emulsion relating to the invention, the tabular grains having an aspect ratio of 2 or more account for 50% or more, preferably 60% or more and more preferably 70% or more of the projected area of total grains. The silver halide emulsion is preferably monodisperse and a coefficient of variation of grain size is preferably 20% or less.

The tabular silver halide grains may be silver chloride, silver bromochloride or silver iodochloride with respect to halide composition. The average chloride content is 20 mol % or more, preferably, 20 to 95 mol % or more and more preferably 30 to 70 mol %. When the chloride content id less than 20 mol %, processability (e.g., developability, fixability) is deteriorated and becomes unsuitable for rapid processing. When the chloride content exceeds 95 mol %, lowering of sensitivity or deterioration of silver image tone is marked and not preferable. With respect to halide composition within the grain, the tabular grains may be uniform or localized.

Preparation of the tabular silver halide grain emulsion used in the invention is referred to JP-A 58-113926, 58-113927, 58-113934 and 62-1855, and European Patent 218,849 and 219,850. Preparation of a monodisperse tabular grain emulsion is also referred to JP-A 61-6643.

In a process of preparing tabular silver iodochlorobromide grain emulsion with a high aspect ratio, to a gelatin aqueous solution kept at a pBr of 3 or less were simultaneously added a silver nitrate aqueous solution and a halide aqueous solution to form seed crystal grains, which were further grown by double jet addition to obtain final grains.

The grain size and form of tabular silver halide grains can be controlled by adjusting a temperature, silver potential, pH, flow rates of silver salt and halide solutions during the course of forming grains. An average chloride content of the tabular grain emulsion can be controlled by varying the halide composition of a halide solution to be added, i.e., a proportion of chloride, bromide and iodide. In preparation of the tabular silver halide grain emulsion, a solvent for silver halide such as ammonia, thioethers or thioureas can be optionally used.

The above-mentioned emulsion may be surface latent image forming type, internal latent image forming type or type of forming internal and surface latent images. Among these emulsions, are preferable a surface latent image forming emulsion. In the preparation of these emulsions, an iron salt, cadmium salt, lead salt, thallium salt, ruthenium salt, osmium salt, iridium salt, rhodium salt or their complex salts.

The emulsion may be subjected to noodle washing or flocculation washing to remove soluble salts. As preferred washing methods are cited a technique of using aromatic hydrocarbon aldehyde resin containing a sulfo group described in Japanese Patent examined No. 35-16086 and polymeric coagulating agents, G3, G8, etc. described in JP-A 63-158644.

To terminate chemical sensitization (chemical ripening), it is preferable to employ a chemical ripening restrainer in terms of stability of emulsions. Examples of the ripening restrainer include halides (e.g., potassium bromide, sodium chloride), organic compounds known as an antifoggant or stabilizer (e.g. , 4-hydroxy-1,3,3a,7-tetrazaindene). These compounds may be employed singly or in combination.

In a silver halide emulsion used in the invention, various additives may be incorporated in physical ripening, or before, during or after chemical ripening. As the additives can be employed compounds as described in aforementioned RD Nos. 17643, 18716 and 308119, wherein relevant types of compounds and sections thereof are follows.

| | RD-17643 | | RD-18716 | RD-308119 | |
|---|---|---|---|---|---|
| Additive | Page | Sec. | Page | Page | Sec. |
| Chemical sensitizer | 23 | III | 648 upper right | 996 | III |
| Sensitizing dye | 23 | IV | 648–649 | 996–8 | IVA |
| Desensitizing dye | 23 | IV | | 998 | IVB |
| Dye | 25–26 | VIII | 649–650 | 1003 | VIII |
| Developing accelerator | 29 | XXI | 648 upper right | | |
| Antifoggant/stabilizer | 24 | IV | 649 upper right | 1006–7 | VI |
| Brightening agent | 24 | V | | 998 | V |
| Hardening agent | 26 | X | 651 left | 1004–5 | X |
| Surfactant | 26–27 | XI | 650 right | 1005–6 | XI |
| Plasticizer | 27 | XII | 650 right | 1006 | XII |
| Lubricant | 27 | XII | | | |
| Matting agent | 28 | XVI | 650 right | 1008–9 | XVI |
| Binder | 26 | XXII | | 1003–4 | IX |
| Support | 28 | XVII | | 1009 | XVII |

With respect to a coating weight of silver (denoted as "Ag") and a coating weight of gelatin of the total hydrophilic colloid layers including a silver halide emulsion layer (denoted as "Gel") provided on a support of the silver halide photographic material relating to the invention, a weight ratio of Ag/Gel id 0.6 or more, preferably 0.6 to 1.5 and more preferably 0.7 to 1.3. There is specifically no upper limit with respect to the ratio of Ag/Gel, but it is preferably 0.6 to 1.5 and more preferably 0.6 to 1.3. When it exceeds 1.5, pressure resistance (e.g., roller mark, abrasion mark) is markedly deteriorated.

Examples of supports usable in the photographic materials relating to the invention include those described in afore-mentioned RD-17643, page 28 and RD-308119, page 1009. As an appropriate support are cited polyethylene terephthalate films. The surface of the support may be provided with a sublayer or subjected to corona discharge or UV exposure, in order to improve adhesive property of coating layers.

In processing of the photographic material by an automatic processor, a solid processing composition can be used. The solid processing composition may be in the form of a tablet, pellet, granules or powder. The solid processing composition, if necessary, may be subjected to moisture-proof treatments. In the invention, the powder refers to an aggregate of fine crystals and the granules refer to those prepared by subjecting the powder to granulation treatments and with granular size of 50 to 5000 $\mu$m. The tablet refers to those prepared by subjecting the powder or granules to compression-molding to a given form.

As a embodiment of the invention, the developing composition or fixing composition relating to the invention is in the form of solid. The developing or fixing composition can be solidified in such a manner that the processing composition in the form of a concentrated solution, fine powder or granules is mixed with a water soluble bonding agent and then the mixture is molded, or the water soluble bonding agent is sprayed on the surface of temporarily-molded processing composition to form a covering layer, as described in JP-A 4-29136, 4-85533, 4-85534, 4-85535, 4-85536 and 4-172341.

Further, the solid developing composition or solid fixing composition is preferably in the form of a tablet. A preferred tablet-making process is to form a tablet by compression-molding after granulating powdery processing composition. As compared to a solid composition prepared simply by mixing the processing composition to form a table, there is an advantage that improvements in solubility and storage stability were achieved and resultingly, the photographic performance becomes stable.

As for granulation process which is carried out prior to tablet-making process, any conventionally known method such as fluidized-bed granulation process, extrusion granulation process, compression granulation process, crush granulation process, fluid layer granulation process, and spray-dry granulation process can be employed. It is preferred that the average grain size of the granules is 100 to 800 $\mu$m and preferably 200 to 750 $\mu$m. In particular, 60% or more of the granules is with a deviation of −100 to 150 $\mu$m. When the grain size smaller, it tends to cause localization of mixing elements and therefore, is undesirable. As hydraulic press machine, any conventional compression molding machine, such as a single-engine compression molding machine, rotary-type compression machine, briquetting machine, etc. may be employed to form a tablet. Compression-molded (compression-tableted) solid processing composition may take any form and is preferably in a cylindrical form from the point of productivity, handleability and problems of powder dust in cases when used in user-side. It is further preferred to granulate separately each component, such as an alkali agent, reducing agent and preservative in the above process.

The solid developing or fixing composition in the form of a tablet can be prepared according to methods, as described in JP-A 51-61837, 54-155038, 52-88025, and British Patent 1,213,808. The granular processing composition can also be prepared according to methods. As described in JP-A 2-109042, 2-109043, 3-39735 and 3-39739. The powdery processing composition can be prepared according to methods, as described in JP-A 54-133332, British Patent 725,892 and 729,862 and German Patent 3,733,861.

In the case of the solid developing or fixing composition being in the form of a tablet , its bulk density is preferably 1.0 to 2.5 g/cm$^3$ in terms of solubility and effects of the invention. When being not less than 1.0 g/cm$^3$, it is advantageous for strength of the solid composition; and when being not more than 2.5 g/cm$^3$, it is advantageous for solubility. In the case of the developing or fixing composition in the form of granules or powder, its bulk density is preferably 0.40 to 0.95 g/cm$^3$.

The solid developing or fixing composition can be used as not only a developer or fixer but also a photographic processing chemicals such as a rinsing agent. Particularly when used as a developer or fixer, effects of stabilizing photographic performance are marked.

A processing chemical having at least a part solidified and a solid processing chemical each applicable to the invention are included in the scope of the invention. It is, however, preferable that the whole component of these processing chemicals are solidified. It is also preferable that the components thereof are each molded into a separate solid processing chemical and then individually packed in the same form. It is further preferable that the components are packed in series in the order of periodically and repeatedly adding them from the packages.

It is preferable that all the processing chemicals are solidified and are then replenished to the corresponding processing tanks so as to meet the information on a processing amount. When an amount of replenishing water is required, it is replenished in accordance with an information on a processing amount or another information on the replenishing water control. In this case, the liquids to be replenished to a processing tank can only be replenishing water. In other words, when a plurality of processing tanks are required to be replenished, the tanks for reserving some replenishing liquids can be saved to be only a single tank by making use of replenishing water in common, so that an automatic processor can be made compact in size. In particular for making the automatic processor compact in size, it is preferable to put a water replenishing tank to the outside of the automatic processor.

When solidifying a developer, all of an alkali agent and reducing agent are solidified, and when the developer is solidified in the form of a tablet, the number of the tablets may be not more than 3 tablets, preferably, 1 tablet. When the solid processing chemicals are solidified separately into not less than 2 tablets, it is preferable to pack these plural tablets or granules in the same package.

In the invention, the solid developing composition preferably contains the compound represented by Formula (I) or (II). The compound is contained in an amount of 0.005 to 1 mol and more preferably 0.05 to 0.5 mol per liter of developer. When the content thereof is less than 0.005 mol/l, preservability of the developer is easily deteriorated. When the content exceeds 1 mol/l, developability is deteriorated and lowering of gamma (γ, contrast) occurs.

As for the means for supplying a solid processing chemical to a processing tank in the invention, and in the case where the solid processing chemical is of the tablet type, for example, there are such a well-known means as described in Japanese Utility Model OPI Publication Nos. 63-137783/1988, 63-97522/1988 and 1-85732/1989, wherein, in short, any means may be used, provided that at least a function for supplying a tableted chemical to a processing tank can be performed. And, in the case where the solid processing chemical is of the granulated or powdered type, there are such a well-known means such as the gravity dropping systems described in JP OPI Publication Nos. 62-81964/1987, 63-84151/1988 and 1-292375/1989, and the screw system described in JP OPI Publication Nos. 63-105159/1987 and 63-84151/1988. However, the invention shall not be limited to the above-given well-known means.

Among them, however, a preferable means for supplying a solid processing chemical to a processing tank is such a means, for example, that a prescribed amount of a solid processing chemical is weighed out in advance and is then separately packed and the package thereof is opened and the chemical is then taken out of the package so as to meet the quantity of light-sensitive materials to be processed. To be more concrete, every prescribed amount of a solid processing chemical and, preferably, every amount for a single replenishment is sandwiched between at least two packing materials constituting a package. When separating the package into two directions or opening a part of the package, the solid processing chemical can be ready to take out thereof. The solid processing chemical ready to be taken out thereof is readily be supplied to a processing tank having a filtration means by naturally dropping the chemical. The prescribed amounts of the solid processing chemicals are each separately packed respectively in a tightly sealed package so as to shut off the open air and the air permeability to any adjacent solid processing chemicals. Therefore, the moisture resistance can be secured unless the packages are opened.

In an embodiment of the invention, it may be to have a constitution in which a package comprising at least two packing materials sandwiching a solid processing chemical therebetween is brought into close contact with or made adhered to the peripheries of the solid processing chemical on each of the contacting surfaces of the two packing materials so as to be separable from each other, if required. When each of the packing materials sandwiching the solid processing chemical therebetween is pulled each to the different directions, the close contacted or adhered surfaces are separated from each other, so that the solid processing chemical can be ready to take it out.

In another embodiment of the invention, it may be to have the following constitution. In a package comprising at least two packing materials sandwiching a solid processing material therebetween, at least one of the packing materials thereof can be ready to open the seal by applying an external force. The expression, "to open a seal", stated herein means that a packing material is notched or broken off as a part of the packing material remains unnotched or unbroken off. It may be considered to open a seal in such a manner that a solid processing chemical is forcibly extruded by applying a compression force from the side of a packing material subject to be unopened through a solid processing chemical to the direction of a packing material made ready to be opened, or that a solid processing chemical can be ready to take out by notching a packing material subject to be opened by making use of a sharp-edged member.

A supply-starting signal can be obtained by detecting an information on a processing amount. Based on the obtained supply-starting signal, a driving means for separation or opening a seal is operated. A supply-stopping signal can be obtained by detecting an information on the completion of a specific amount of supply. Based on the obtained supply-stopping signal, a driving means for separation or opening a seal is so controlled as to be stopped in operation.

The above-mentioned solid processing chemical supplying means has a means for controlling the addition of a specific amount of the solid processing chemical, that is an essential requirement for the invention. To be more concrete, in an automatic processor of the invention, these means are required to keep every component concentration constant in each processing tank and to stabilize every photographic characteristic. The term, "an information of the processing amount of silver halide photographic light-sensitive materials", means an information on a value obtained in proportion to an amount of silver halide photographic light-sensitive materials to be processed with a processing solution, to an amount of silver halide photographic light-sensitive materials already processed or to an amount of silver halide photographic light-sensitive materials being processed, and the values indicate indirectly or directly an amount of a processing chemical reduced in a processing solution. The values may be detected at any point of time before and after a light-sensitive material is introduced into a processing solution or during the light-sensitive material is dipped in the processing solution. An amount of a light-sensitive material printed by a printer may also be detected for this purpose. A concentration or concentration variation of a processing solution reserved in a processing tank may further be detected. An amount discharged to the outside after a processing solution is dried up may also be detected.

A solid processing composition of the invention may be added to any position inside a processing tank and, preferably, to a position communicated with a section for processing a light-sensitive material and circulating a processing solution between the processing tank and the processing section. It is also preferable to have such a structure that a certain amount of processing solution can be circulated therebetween so that a dissolved component can be moved to the processing section. It is further preferable that a solid processing chemical is added to a thermostatically controlled processing solution.

Generally in an automatic processor, the temperature of a processing solution loaded therein is controlled by an electric heater. As for a general method thereof, a heat exchanger section is provided to an auxiliary tank connected to a processing tank and a heater is also provided thereto, and a pump is further arranged so as to circulate a given amount of the solution from the processing tank to the auxiliary tank and keep the temperature constant.

For the purpose of removing a crystallized foreign substance contained in a processing solution or produced in a crystallization, a filter is usually arranged.

It is allowed to connect a replenishing tank to a section connected to a processing section, such as the above-mentioned auxiliary tank.

All materials of the filters, filtration devices and so forth applicable to any ordinary automatic processors can also be used in the invention, and a specific structures and materials shall not affect the effects of the invention.

In the invention, the circulation frequency of a processing solution circulated by a circulation means is to be within the range of, 0.5 to 2.0 times/minute, preferably 0.8 to 2.0 times/minute and more preferably 1.0 to 2.0 times/minute. The expression, "a circulation frequency", herein is related to a flow rate of a liquid to be circulated, and one circulation herein means when a liquid amount corresponding to the total liquid amount reserved in a processing tank is flowed out. The solid processing composition is added to the processing tank, separately from the replenishing water. The replenishing water is supplied from the water storage tank.

The developer used in the invention preferably contains, as a developing agent, dihydroxybenzenes described in Japanese Patent Application No. 4-286232(page 19–20), aminophenols, pyrazolidones or reductones described in JP-A 5-165161. Of the pyrazolidones, 4-substituted ones (e.g., dimezone, dimezone S) are water soluble and their solid composition is superior in aging stability.

The developing solution used in the invention may contain, as a preservative, an organic reducing agent as well as a sulfite described in JP-A 6-138591. Further, a bisulfite adduct of a hardening agent described in Japanese Patent Application No. 4-586323 is also usable. Compounds described in JP-A 5-289255 and 6-308680 (general formulas 4-a and 4-b) may be contained as an antisludging agent. Addition of a cyclodextrin compound is preferred, particularly as described in JP-A 1-124853.

An amine compound may be added to the developing solution, as described in U.S. Pat. No. 4,269,929.

A buffering agent may be used in the developing solution, including sodium carbonate, potassium carbonate, potassium bicarbonate, trisodium phosphate, tripotassium phosphate, dipotassium phosphate, sodium borate, potassium borate, sodium tetraborate, potassium tetraborate, sodium o-hydroxybenzoate (sodium salicylate), potassium o-hydroxybenzoate (potassium salicylate), sodium 5-sulfo-2-hydroxybenzoate (sodium salicylate) and potassium 5-sulfo-2-hydroxybenzoate (potassium salicylate).

There can be added, as a development accelerating agent, thioether compounds described in JP-B 37-16088, 37-5987, 38-7826, 44-12380 and 45-9019 (herein, the term, "JP-B" means examined and published Japanese Patent) and U.S. Pat. No. 3,813,247; p-phenylenediamine compounds described in JP-A 52-49829 and 50-15554;quaternary ammonium salts described in JP-B 44-30074, JP-A 50-137726, 56-156826 and 52-43429; p-aminophenols described in U.S. Pat. No. 2,610,122, and 4,119,462; amine compounds described in U.S. Pat. Nos. 2,494,903, 3,128, 182, 4,230,796, 3,253,919, 2,482,546, 2,596,926 and 3,582, 346 and JP-B 41-11431; polyalkylene compounds described in JP-B 37--16088, 42-25201, 41-11431 42-23883, U.S. Pat. Nos. 3,128,183, 3,532,501; 1-phenyl-3-pyrazolidones; hydrazines, mesoion type compound and imidazoles.

Alkali metal halides such as potassium iodide are used as a antifoggant. Organic antifoggants include benzotriazole, 6-nitrobenzimidazole, 5-nitrobenzimidazole, 5-methylbenzotriazole, 5-nitrobenzotriazole, 5-chlorobenzotriazole, 2-thiazolyl-benzimidazole, 2-thiazolylmethyl-benzimidazole, indazole, hydroxyazaindolizine, adenine and 1-pheny-5-mercaptotetrazole.

In the developer composition used in the invention, methylcellosolve, methanol, acetone, dimethylformamide, cyclodextrin compounds and compounds described in JP-B 47-33378 and 44-9509 can be employed as an organic solvent to enhance solubility of the developing agent.

Furthermore, various additives such as an antistaining agent, antisludging agent and interlayer effect-accelerating compound are optionally added.

In a fixed used in the invention are incorporated known compounds usable in a fixer, such as a fixing agent, chelating agent, pH buffer, hardening agent, preservative, as described in JP-A 4-242246 (page 4) and 5-113632 (pages 2–4). Further are usable hydrosulfite adduct of a hardening agent, as a hardening agent, described in Japanese Application 4-586323 (pages 2–4) and known fixing accelerators. Chelating agents are also employed as a hardener or a softening agent of tap water. Preferred chelating agents are compounds represented by Formula (I) or (II).

When photographic materials are processed by an automatic processor including steps of developing, fixing, washing and drying, the process of developing to drying is preferably completed within 120 sec. and more preferably within 90 sec. Thus, A period from the time a top of a photographic material is immersed into a developer to the time, through the steps of developing, fixing, washing and drying, to the time the top comes out from a drying zone is preferably 120 sec. or less and more preferably 90 sec. or less.

In the invention, a developing time is 6 to 30 sec and a developing temperature is 25° to 50° C. (preferably, 30° to 40° C.). a fixing time and temperature are 6 to 30 sec. and 20° to 50° C. (preferably, 6 to 20 sec. and 30° to 40° C.). Drying is conventionally carried out at 35° to 100° C. and preferably by impinging hot air of 40° to 80° C. There may be provided a drying zone with a far-infrared ray heating means in a processor.

A processor provided with mechanism of supplying water or an acidic rinsing solution having no fixing ability to a photographic material, as disclosed in JP-A 3-264953, can be employed. There may be built in a processor an apparatus in which a developer or fixer can be prepared.

A developer or fixer can be replenished by a replenishing method based on width and transporting speed, as described in JP-A 55-126243 or an area-based replenishing method controlled by the number of continuously processed sheets, as described in JP-A 1-149156. The replenishing rate is preferably 260 ml or less, more preferably 50 to 260 ml and furthermore preferably 70 to 200 ml per $m^2$. It is difficult to maintain development activity at a replenishing rate of less than 50 ml/$m^2$, leading to lowering in sensitivity and contrast with aging or increasing of the processed sheet number. The replenishing rate of 260 ml/$m^2$ or more is not preferable for environment protection.

It is preferred to add a starter prior to processing. A solidified starter is also preferred. An organic acid such as polycarboxylic acid compound, alkali earth metal halide, organic restrainer or development accelerator is used as a starter.

EXAMPLES

Embodiments of the present invention will be explained based on the following examples, but the invention is not limited to these examples.

Example 1

In this example, the present invention is applied to photographic materials usable as a X-ray photographic material and suitable for rapid processing.

Preparation of silver chlorobromide emulsion

Preparation of Emulsion A-1

Using the following solutions A, B and C, a silver chlorobromide emulsion was prepared.

| | |
|---|---|
| Solution A: | |
| Ossein gelatin | 6 g |
| Polyisoprene-polyethyleneoxy-di-succinic acid ester sodium salt (10% ethanol) | 1 ml |
| Distilled water | 700 ml |
| Solution B: | |
| Silver nitrate | 170 g |
| Distilled water | 410 ml |
| Solution C: | |
| Sodium chloride | 35.1 g |
| Potassium bromide | 47.6 g |
| Hexachloroiridate | 50 μg |
| Polyisoprene-polyethyleneoxy-di-succinic acid ester sodium salt (10% ethanol) | 3 ml |
| Ossein gelatin | 11 g |
| Distilled water | 407 ml |

To solution A maintained at 40° C. was added sodium chloride to adjust the EAg to 120 mV. Then, using a mixing stirrer described in JP-A 57-92523 and 57-92524 were added solutions B and C by double jet addition. Addition was made acceleratedly, as shown below, over a period of 25 min., while the EAg was controlled.

At 7 min. after the start of the addition, the EAg was varied from 120 mV to 100 mV and further maintained at this value until completing addition. The EAg was controlled using an aqueous solution of sodium chloride (3 mol/l).

| Add. time (min.) | Solution B (ml/min.) | Solution C (ml/min.) |
|---|---|---|
| 0 | 5.4 | 5.3 |
| 7 | 5.4 | 5.3 |
| 10 | 22.0 | 21.6 |
| 25 | 22.0 | 21.6 |

The EAg was measured using a silver electrode and a double-junction type saturated Ag/AgCl reference electrode (arrangement of electrodes were referred to described in JP-A 57-197534). Solutions B and C were added using a flow-variable roller tube pump. During addition, the emulsion was sampled out and no formation of new nucleus grains was confirmed through electronmicroscopic observation. The pH was maintained at 3.0 with a 3% nitric acid aqueous solution.

After completing addition of solutions B and C, the emulsion was further Ostwald-ripened for 10 min. and then desalted at 40° C., using a Demol-N solution (produced by Kao-Atlas, condensation product of sodium naphthalenesulfonate and aldehyde) and an aqueous solution of magnesium sulfate. Adding thereto 600 ml of an aqueous ossein gelatin solution containing 15 g of ossein gelatin, the emulsion was redispersed with stirring for 30 min. and a total volume was made to 750 ml. There was obtained a silver chlorobromide emulsion (A-1) comprised of cubic grains with an average size of 0.4 μm and 60 mol % chloride (and an aspect ratio as shown in Table 2).

Preparation of Emulsions B-1, B-2 and B-3

To a reaction vessel provided with a stirrer were added 6000 g of distilled water containing 90 g of high methionine-containing gelatin )methionine content of 59.7 μmol per g of gelatin), 0.5 M $CaCl_2 2H_2O$ and 118.5 g of NaBr. 0.5M silver nitrate solution was added for 4 min., in an amount of 1.6% of a total silver amount, while the pH was kept with NaOH or $HNO_3$ at 40° C. 98.4% of the remaining silver was added linearly acceleratedly (10 times from the start to final). At each of 4 min., 16 min. and 36 min. after the start of precipitation was added 30 cc of 37 mM adenine aqueous solution. At 10 min. after the start was added 3.78 g of 3M $CaCl_2$ solution. At the time adenine and $CaCl_2$ were added, addition of a silver salt was interrupted for 1 min. to uniformly mix additives. 1.44 mol of silver halide precipitated in total.

The emulsion was desalted at 40° C., using a Demol-N solution (produced by Kao-Atlas, condensation product of sodium naphthalenesulfonate and aldehyde) and an aqueous solution of magnesium sulfate. Adding thereto 600 ml of an aqueous ossein gelatin solution containing 15 g of ossein gelatin, the emulsion was redispersed with stirring for 30 min. and a total volume was made to 750 ml. There was obtained a silver chlorobromide emulsion (B-1) comprised of cubic grains with an average size of 0.4 μm, coefficient of variation of 0.25, 20 mol % chloride and an aspect ratio of 4.

Silver chlorobromide emulsions (B-2) and (B-3) were prepared in a similar manner, provided that the amount of $CaCl_2$ or NaBr was varied.

Preparation of Emulsions C-1, C-2 and C-3

Emulsion C-1 was prepared in a manner similar to emulsion B-1, provided that 112.5 g of NaBr was added to the reaction vessel. There was obtained a silver chlorobromide tabular grain emulsion (C-1) with average chloride of 25 mol %, average grain size of 0.4 μm, coefficient of variation of 0.25 and aspect ratio of 9.

Emulsion C-2 was prepared in a manner similar to emulsion B-1, provided that NaBr was not added to the reaction vessel. There was obtained a silver chloride tabular grain emulsion (C-2) with average grain size of 0.4 μm, coefficient of variation of 0.25 and aspect ratio of 9.

Emulsion C-3 was prepared in a manner similar to emulsion B, provided that 75 g of NaBr was added to the reaction vessel. There was obtained a silver chlorobromide tabular grain emulsion (C-1) with average chloride of 50 mol %, average grain size of 0.4 μm, coefficient of variation of 0.25 and aspect ratio of 4.

TABLE 1

| Emulsion | Chloride content (mol %) | AR | Grain form | Average grain size (μm) |
|---|---|---|---|---|
| A-1 | 60 | 1 | Cubic | 0.4 |
| B-1 | 20 | 4 | Tabular | 0.4 |
| B-2 | 10 | 4 | Tabular | 0.4 |
| B-3 | 60 | 4 | Tabular | 0.4 |
| C-1 | 25 | 9 | Tabular | 0.4 |
| C-2 | 100 | 9 | Tabular | 0.4 |
| C-3 | 50 | 4 | Tabular | 0.4 |

AR: aspect ratio

Preparation of samples

To each emulsion kept at 50° C. were sensitizing dyes (A) and (B) of 250 mg and 15 mg per mol of silver, respectively. Then, adding ammonium thiocyanate of $7.0\times10^{-4}$ mol per mol of silver and optimal amounts of chloroauric acid and hypo, chemical ripening was carried out and further thereto added a silver iodide fine grain emulsion with an average grain size of 0.06 μm was added in an amount of $6.0\times10^{-4}$ mol per mol of silver. After completion of ripening the emulsion was stabilized by adding $3\times10^{-2}$ mol of 4-hydroxy-6-methyl-1,3,3a,7-tetrazaindene.

Sensitizing dye (A): 5,5'-Dichloro-9-ethyl-3,3'-di(3-sulfo-propyl)oxacarbocyanine sodium salt anhydride Sensitizing dye (B): 5,5'-di-(butoxycarbonyl)-1,1'-diethyl-3,3'-di-(4-sulfobutyl) benzoimidazolocarbocyanine sodium salt anhydride Additives used in each emulsion solution (silver halide coating solution) were as follows. The addition amount was represented in an amount per mol of silver halide.

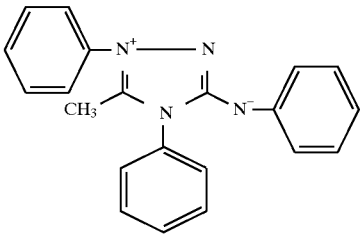

150 mg

| | |
|---|---|
| t-Butylcatechol | 400 mg |
| Polyvinyl pyrrolidone (MW 10,000) | 1.0 g |
| Styrene-anhydrous maleic acid copolymer | 2.5 g |
| Trimethylolpropane | 10 g |
| Diethylene glycol | 5 g |
| Nitrophenyl-triphenyl-phosphonium chloride | 50 mg |
| Ammonium 1,3-dihydoxybenzene-4-sulfonate | 4 g |
| Sodium 2-mercaptobenzimidazole-5 sulfonate | 1.5 mg |

-continued

Compound (H)

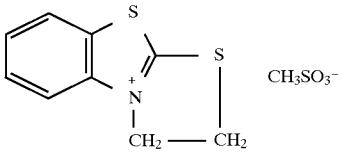

70 mg $n\text{-}C_4H_9OCH_2CH(OH)CH_2N(CH_2COOH)_2$ 1 g

Additives used in a protective layer coating solution were as follows. The amount was represented in an amount per g of gelatin.

| | |
|---|---|
| Matting agent (polymethyl methacrylate, area-averaged particle size of 7 μm) | 7 mg |
| Colloidal silica (av. size 0.013 μm) | 70 mg |
| Sodium 2,4-dichloro-6-hydroxy-1,3,5-triazine | 30 mg |
| $(CH_2{=}CHSO_2{-}CH_2{-})_2O$ | 36 mg |

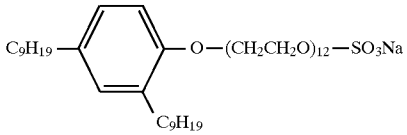

12 mg

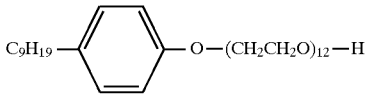

2 mg $CH_2COO(CH_2)_9CH_3$
$CHCOO(CH_2)_2CH(CH_3)_3$
$SO_3Na$ 7 mg

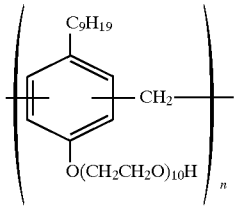

15 mg (n = 2–5)

$NaO_3S{-}CH(CH_2COOCH_2(C_2F_4)_3H){-}COOCH_2(C_2F_4)_3H$ 3 mg $F_{19}C_9{-}O{-}(CH_2CH_2O)_{10}CH_2CH_2{-}OH$ 3 mg

Using above coating solutions, photographic material samples were prepared in the following manner. A photographic emulsion layer with a gelatin amount as shown in Table 3 and silver coverage of 1.6 g/m$^2$ and a protective layer with a gelatin amount of 0.9 g/m$^2$ were simultaneously coated on both sides of a support by using two slide-hopper type coater at a coating speed of 80 m/min. and dried for 2 min. 20 sec. to obtain a sample. There was employed a support which was subbed with 10 wt. % aqueous dispersing solution of a copolymer comprised of monomers of glycidyl methacrylate of 50 wt. %, methyl methacrylate of 10 wt. % and butyl methacrylate of 40 wt. %. The support was blue-tint polyethylene terephthalate film base with thickness of 175 μm and for use in X-ray photographic films.

Samples were evaluated in the following manner.

Evaluation of contrast

Each sample was sandwiched between two sheets of radiographic intensifying screens, KO-250 and exposed, through an aluminum wedge, to X-ray at a tube voltage of 80 kVp and tube current of 100 mA for 0.05 sec. Then exposed samples were processed by a modified of roller transport type processor SRX-502(product of Konica), using the following developer and fixer.

Contrast was represented by a slope (tan α) of a line connecting a density of 1.0 and that of 2.0 on a characteristic curve.

Evaluation of roller mark

Samples were each exposed so as to give a density of 1.0, processed and visually evaluated based on the following five criteria.

5: No pressure mark

4: Slight marks are observed in the peripheral portion of the film, but no problem in practical use 3: Slight marks were observed in the central portion of the film, but no problem in practical use 2: Dense marks were observed in the peripheral portion of the film, and problem in practical use 1: Dense marks were observed in the central and peripheral portions of the film and no practical use Processing solutions were as follows.

| Developer: | |
|---|---|
| Part A (to make 12 liters) | |
| Potassium hydroxide | 450 g |
| Potassium sulfite (50% solution) | 2280 g |
| Chelating agent as shown in Table 3 | |
| Sodium hydrogencarbonate | 132 g |
| Boric acid | 40 g |
| 5-Methylbenzotriazole | 140 mg |
| 1-Phenyl-5-mercaptotetrazole | 250 mg |
| 4-Hydroxymethyl-4-methyl-1-phenyl-3 -pyrazolidone | 102 g |
| Hydroquinone | 390 g |
| Diethylene glycol | 550 g |
| Water to make | 6000 ml |

-continued

| Part B (to make 12 liters) | |
|---|---|
| Glacial acetic acid | 70 g |
| 5-Nitroindazole | 0.6 g |
| Glutar aldehyde (50% solution) | 8.0 g |
| n-Acetyl-D,L-penicilamine | 1.2 g |
| Starter: | |
| Glacial acetic acid | 120 g |
| $HO(CH_2)_2S(CH_2)_2S(CH_2)_2OH$ | 1 g |
| KBr | 225 g |
| $CH_3N(C_3H_6NHCONHCH_2SC_2H_5)_2$ | 1 g |
| Water to make | 1 liter |
| Fixer: | |
| Part A (to make 18.3 liters) | |
| ammonium thiosulfate (70 wt./vol %) | 4500 g |
| Sodium sulfite anhydride | 450 g |
| Sodium acetate trihydride | 450 g |
| Boric acid | 110 g |
| Tartaric acid | 60 g |
| Sodium citric acid | 10 g |
| Gluconic acid | 70 g |
| 1-(N,N-dimethylamino)-ethyl-5-mercapto-tetrazole | 18 g |
| Glacial acetic acid | 330 g |
| Aluminum sulfate | 62 g |
| Water to make | 200 ml |

The developer was prepared by adding Parts A and B to water of 5 liters with stirring and further adding water to make 12 liters, and the pH was adjusted to 10.53. This was used as a developer replenishing solution. To 1 liter of the developer replenishing solution was added 20 ml of the starter and the pH was adjusted to 10.30. This was used as a developer working solution. The fixer was prepared by adding Part A to water of 5 liters and further adding water to make 18.3 liters and the pH was adjusted to 4.6 with sulfuric acid and ammonia. This was used as a fixer replenishing solution. The replenishing rate of the developer or fixer was 240 ml per $m^2$ of photographic material. The developing temperature and fixing temperature were 35° C. and 33° C., respectively. The processing time was varied and the total processing time was 45 sec. or 25 sec., provided that evaluation of roller marks was made in 45 sec. processing. Results thereof are shown in Table 2.

TABLE 2

| Sample No. | Emulsion | Gelatin of emulsion layer ($g/m^2$) | Ag/Gel ratio | Chelating agent (mol/1) | | Contrast 45" processing | Contrast 25" processing | Roller mark | Remark |
|---|---|---|---|---|---|---|---|---|---|
| 1 | A-1 | 1.56 | 0.65 | II-1 | (0.05) | 2.6 | 2.45 | 1 | Comp. |
| 2 | A-1 | 2.30 | 0.50 | II-1 | (0.05) | 2.35 | 1.8 | 4 | Comp. |
| 3 | B-2 | 1.56 | 0.65 | II-1 | (0.05) | 2.5 | 1.95 | 3 | Comp. |
| 4 | B-1 | 1.56 | 0.65 | II-1 | (0.05) | 2.5 | 2.3 | 4 | Inv. |
| 5 | B-3 | 2.30 | 0.50 | II-1 | (0.05) | 2.45 | 1.9 | 5 | Comp. |
| 6 | B-3 | 1.56 | 0.65 | DTPA* | (0.05) | 2.65 | 2.5 | 4 | Comp.** |
| 7 | B-3 | 1.56 | 0.65 | II-1 | (0.05) | 2.65 | 2.5 | 5 | Inv. |
| 8 | B-3 | 1.56 | 0.65 | I-1 | (0.05) | 2.65 | 2.5 | 5 | Inv. |
| 9 | B-3 | 1.10 | 0.80 | II-1 | (0.05) | 2.75 | 2.65 | 4 | Inv. |
| 10 | C-1 | 1.10 | 0.80 | II-1 | (0.05) | 2.6 | 2.45 | 3 | Inv. |
| 11 | C-2 | 1.10 | 0.80 | II-1 | (0.05) | 2.7 | 2.65 | 3 | Inv. |
| 12 | C-3 | 1.10 | 0.80 | II-1 | (0.05) | 2.6 | 2.5 | 4 | Inv. |

*DTPA: Diethylenetriaminepentaacetic acid

**Biodegradability of a developer was low.

As can be seen from Table 2, inventive samples were proved to be at a level with no problem in practical use with respect to roller marks ad suitable, as compared to comparative samples and suitable for rapid processing in terms of being little difference in contrast between 45 sec. processing and 25 sec. processing. Furthermore, chelating agents relating to the invention were proved to be high in biodegradability and had no problem in waste liquor treatments. Contralily, DTPA was low in its biodegradability.

What is claimed is:

1. A method for processing a silver halide light sensitive photographic material comprising a support having on at least one side of the support hydrophilic colloid layers including a silver halide emulsion layer, comprising exposing the photographic material and developing the exposed photographic material with a developer wherein said silver halide emulsion layer contains tabular silver halide grains having an average chloride content of 20 mol % or more and an aspect ratio of 2 or more; and a coating weight ratio of silver to gelatin of said hydrophilic colloid layers is 0.6 or more; said photographic material being developed in the presence of a compound represented by the following formula (I) or (II):

formula (I)

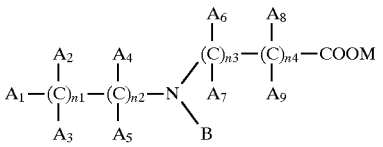

wherein B represents a hydrogen atom, OH of $CH_2COOM$; when B is a hydrogen atom, $A_1$ through $A_9$ each independently represent a hydrogen atom, OH, $C_nH_{2n+}$ or $(CH_2)_mX$, in which n is an integer of 1 to 3, m is an integer of 0 to 3 and X represents COOM, $NH_2$ or OH, $n_1$, and $n_2$ are each 1, $n_3$ and $n_4$ are each an integer and $n_3$ plus $n_4$ is 1 to 4 provided that all of $A_1$ to $A_5$ are not hydrogen atoms at the same time; when B is OH or $CH_2COOM$, $n_1$ and $n_2$ are each an integer including 0 and $n_1$ plus $n_2$ is 2, $n_3$ is 0 and $n_4$ is 1, $A_1$, $A_8$ and $A_9$ each represent a hydrogen atom, $A_2$ to $A_5$ each independently represent a hydrogen atom, OH, COOM, $PO_3(M)_2$, $CH_2COOM$, $CH_2OH$ or an a lower alkyl group, provided that at least one of $A_2$ to $A_5$ represents $CH_2COOM$, COOM or $PO_3(M)_2$; M represents a hydrogen atom, an alkali metal or an ammonium group, formula (II)

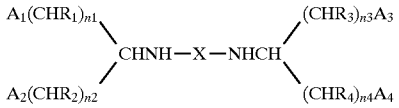

wherein $A_1$ through $A_4$ each independently represent COOM or OH; $n_1$ through $n_4$ each represent an integer of 0 to 2; $R_1$ through $R_4$ each independently represent a hydrogen atom, OH or a lower alkyl group; X represents an alkylene group having 2 to 6 carbon atoms or $—(B_1O)_m—B_2—$, in which $B_1$ and $B_2$ each represent an alkylene group having 1 to 5 carbon atoms and m is an integer of 1 to 5; M represents a hydrogen atom, an alkali metal or an ammonium group.

2. The processing method of claim 1, wherein said tabular grains have an average chloride content of 20 to 95 mol %.

3. The processing method of claim 1, wherein said coating weight ratio of silver to gelatin is 0.6 to 1.5.

4. The processing method of claim 1, wherein said compound represented by formula (I) or (II) is contained in the developer.

5. The processing method of claim 4, wherein said compound is contained in an amount of 0.005 to 1.0 mol/l.

6. The processing method of claim 1, wherein said compound represented by formula (I) or (II) comprises one or more optical isomers and at least 70% of the compound is accounted for by [S,S] optical isomer.

* * * * *